United States Patent [19]

Donnelly

[11] Patent Number: 4,506,624

[45] Date of Patent: Mar. 26, 1985

[54] TROWEL FOR SMOOTHING MORTAR ON THE INTERIOR OF A PIPE

[75] Inventor: Frank Donnelly, Rockaway, N.J.

[73] Assignee: Spiniello Construction Company, Morristown, N.J.

[21] Appl. No.: 301,431

[22] Filed: Sep. 11, 1981

[51] Int. Cl.[3] ..... B05C 7/06; B05C 11/04

[52] U.S. Cl. ..... 118/105; 425/460

[58] Field of Search ..... 118/105, 408, 254, DIG. 10; 425/262, 460

[56] References Cited

U.S. PATENT DOCUMENTS 3,188,710 6/1965 Perkins ..... 425/460
3,263,296 8/1966 Barton ..... 425/460
3,966,389 6/1976 Shubert ..... 118/105 X
4,067,680 1/1978 Perkins ..... 425/460

*Primary Examiner*—John P. McIntosh

[57] ABSTRACT

A trowel for smoothing mortar coated on the interior wall of a pipe, including an elastic member for receiving pressurized air and inflating to a diameter less than the interior of the pipe. A blade assembly is connected to and extends from the elastic member, and defines an outer circular surface substantially corresponding to the coated interior diameter of the pipe for engaging and smoothing said mortar. The blade assembly is constructed and arranged to accommodate variances in the inner diameter of the pipeline.

10 Claims, 3 Drawing Figures

TROWEL FOR SMOOTHING MORTAR ON THE INTERIOR OF A PIPE

BACKGROUND OF THE INVENTION

In the refurbishment or repair of subterranean pipelines it is the common practice to coat the interior pipe walls with a coating of mortar. This is usually achieved by passing a rotating dispersion head through the pipe for spraying the mortar onto the interior pipe walls followed by a trowel which is concentrically located in the pipeline for engaging and smoothing the mortar while still in a plastic condition to insure a uniform coating and a smooth interior surface. The trowel is designed with an outer diameter that corresponds to the inner diameter of the coated pipe walls to insure a smooth, consistent coating for the entire length of the pipeline. However, when the diameter of the interior wall of the pipe varies along the length of the pipe, due to corrosion, the buildup of impurities or the like, the trowel will become oriented in an eccentric relation with the pipeline, and may even jam in the pipeline.

SUMMARY OF THE INVENTION

It is therefore an object of the present invention to provide a trowel that adjusts to variances in the inner diameter of the pipe without becoming eccentric relative to the pipeline and/or binding in the pipeline.

It is still a further object of the present invention to provide an assembly of the above type in which the trowel smooths out the mortar on the inner wall of the pipeline into a uniform coating to define a smooth interior surface notwithstanding variances in the inner diameter of the pipeline.

It is a still further object of the present invention to provide a trowel of the above type in which the trowel blade is formed by a plurality of segments which are movable relative to each other to better accommodate variances in the inner diameter of the pipeline.

Towards the fulfillment of these and other objects the trowel of the present invention includes an elastic member for receiving pressurized air and inflating to a diameter less than the interior diameter of the pipe to be coated, and a blade assembly connected to and extending from the elastic member. The blade assembly defines an outer circular surface substantially corresponding to the coated interior diameter for engaging and smoothing the motar.

BRIEF DESCRIPTION OF THE DRAWINGS

The above brief description as well as further objects, features and advantages of the present invention will be more fully appreciated by reference to the following detailed description of presently preferred but nonetheless illustrative embodiments in accordance with the present invention when taken in conjunction with the accompanying drawings wherein.

DESCRIPTION OF THE PREFERRED EMBODIMENT

Figure 1:
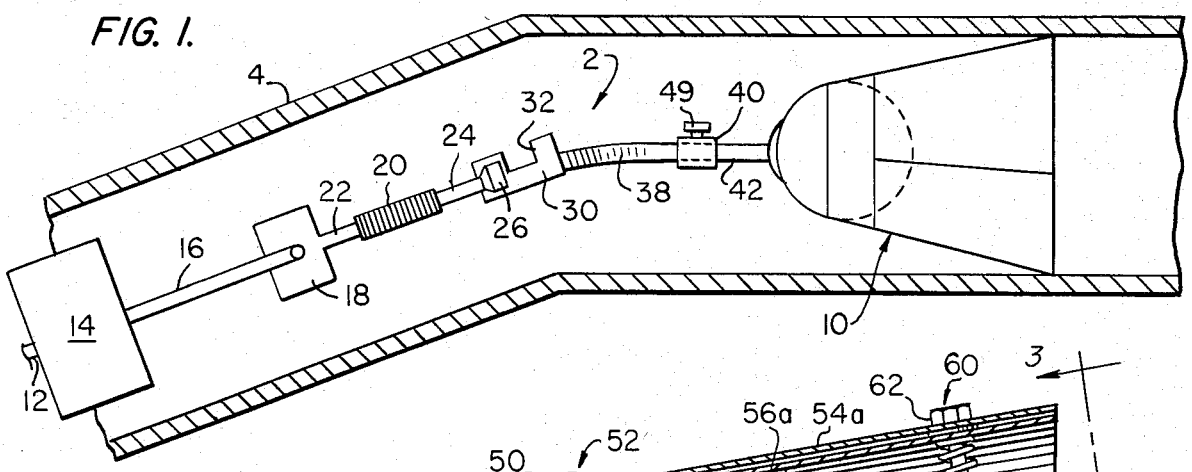
FIG. 1 is a side elevational view of the trowel of the present invention shown installed with its associated equipment in a pipeline depicted in cross section.

Referring to FIG. 1 of the drawings, the reference numeral 2 refers in general to a pipe lining assembly shown disposed in the interior of a pipe 4 for applying and smoothing a coat of mortar to the interior wall of the pipe. The assembly 2 includes a generally frustoconically shaped drag trowel 10 disposed at one end of the assembly 2 and a pull cable 12 at the other end. A lining machine 14, shown schematically for the convenience of presentation, is connected to the cable 12 and has a shaft 16 projecting therefrom which extends within a connector housing 18 and is secured thereto by a set screw, or the like (not shown). One end portion of a coiled spring 20 is formed integral with a stub shaft 22 extending from the housing 18 and the other end of the spring 20 extends over one end portion of another rod 24 having an enlarged head member 26 affixed to its other end. The spring 20 can be affixed to the rod 24 in any known manner, such as by welding.

A keeper member 30 is provided for connecting with the rod 24 and is in the form of a hollow regular polyhedron having a relative large access opening 32 formed in its upper surface and a relative small access opening (not shown) extending through the same surface and in juxtaposition with the opening 32. The large opening 32 is sized to receive the head member 26 and the small opening is sized to receive the rod 24. After insertion into the large opening 32, the rod 24 and the head member 26 can be pulled relative to the keeper member 30 in a direction from right to left as viewed in FIG. 1 whereby the head member 26 slides to the position within the keeper member 30 shown in FIG. 1, that is, immediately below the small opening. This constrains the head member 26 within the keeper member 30 when forces are applied to the cable 14 in a longitudinal direction to pull the assembly 2 through the pipe 4.

An additional coiled spring 38 is secured over a rod (not shown) secured within an end wall of the keeper member 30. The other end of the spring 38 is connected to a dragging head 40 to which a rod 42 extending from the trowel 12 is quick-releasably secured. A set screw 44 extends through an opening formed in the head 40 in threaded engagement therewith and is adapted to engage the rod 42 to retain it in the position shown. The foregoing connecting apparatus is shown and described in detail in applicant's copending application, Ser. No. 243,448, filed Mar. 13, 1981, the disclosure of which is hereby incorporated by reference.

Figure 2:
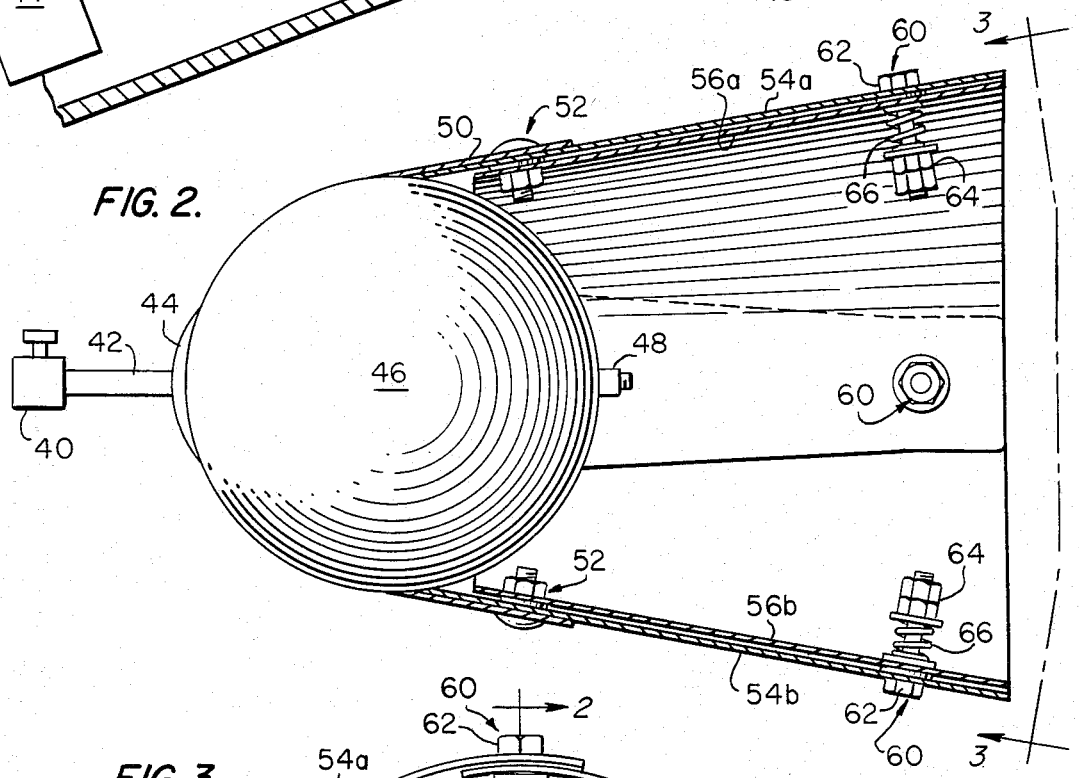
FIG. 2 is a cross-sectional view taken along the line 2—2 of FIG. 3.
Figure 3:
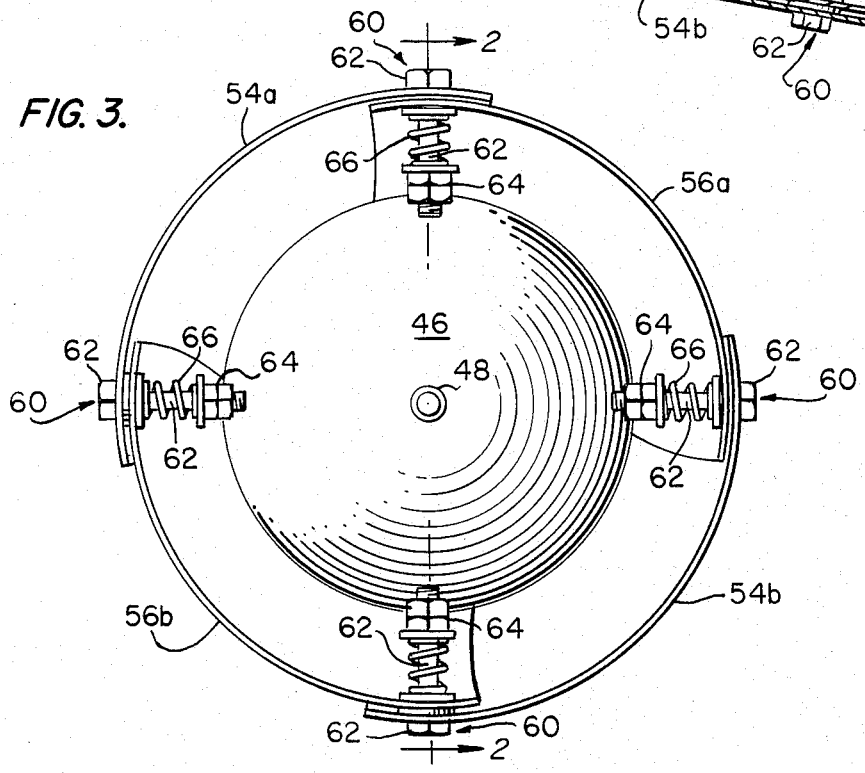
FIG. 3 is a cross-sectional view taken along the line 3—3 of FIG. 2.

The trowel 12 is shown in detail in FIGS. 2 and 3 and includes a disc 44 secured to the rod 42 in any known manner. The disc 44 defines a concave surface which receives an inflatable elastic member 46 which is cemented, or otherwise secured to the disc. The elastic member 46 includes a valve 48 for admitting air under pressure into the interior of the elastic member to inflate it to a size somewhat less than the inner diameter of the pipe 4, as shown in FIG. 1.

A flexible cuff 50 is cemented, or otherwise secured, to the outer periphery of the elastic member 46 and has four openings extending therethrough which extend at 90° intervals, for respectively reviewing four nut-bolt assemblies, two of which are shown in general by the reference numeral 52. The latter assemblies function to connect the cuff 50 to a pair of outer trowel blade segments **54*a* and 54*b* and a pair of inner trowel blade segments 56*a* and 56*b***.

The specific shape and orientation of the trowel blade segments 54*a*, 54*b*, 56*a* and 56*b* are better shown in FIG. 3. As shown, each segment is curved and extends for slightly more than one quarter of a circle, with the end portions of the outer segments 54*a* and 54*b* overlapping the corresponding end portions of the segments 56*a* and 56*b*. The nut-bolt assemblies 52 (FIG. 2) thus extend through these overlapped end portions of the blade segments 54*a*, 54*b*, 56*a* and 56*b* along one side portion of each, to secure them to the cuff 50.

Four spring-loaded assemblies 60 are provided to connect the other side portions of the blade segments 54*a* and 54*b* to the corresponding overlapped portions of the segments 56*a* and 56*b*. More specifically, each nut bolt assembly 60 includes a bolt 62 which extends through corresponding openings formed in the overlapped blade segments, a nut 64 threadedly engaging the end of the bolt and a spring 66 extending between the latter nut and a portion of the overlapped blade segments 56*a* or 56*b*.

As a result, relative movement between the blade segments 54*a* or 54*b* and the blade segments 56*a* or 56*b* is accommodated by the spring loaded nut-bolt assemblies 60.

In operation, the assembly 2 is located substantially coextensive with the centerline of the pipe 4 as shown in FIG. 1, and maintains the frusto-conical portion of the trowel 12 formed by the blade segments 54*a*, 54*b*, 56*a* and 56*b* in a similar orientation even when the assembly 10 and the trowel 12 encounter irregularities in the inner surface of the pipe. For example, if impurities or the like, build up on a portion of the inner wall of the pipe 4 which is encountered by the blade segment 56*a* during passage of the trowel through the pipe, the latter segment will move radially inwardly against the force of the corresponding springs 66 of the respective nut-bolt assemblies 60. Thus the remaining blade segments 54*a*, 54*b* and 56*b* will maintain their concentric orientation with respect to the pipeline and thus insure a smooth and uniform coating of mortar on the interior surface of the pipeline 2 without the danger of binding or jamming.

A latitude of modification, change and substitution is intended in the foregoing disclosure and in some instances some features of the invention will be employed without a corresponding use of other features. Accordingly, it is appropriate that the appended claims be construed broadly and in a manner consistent with the spirit and scope of the invention therein.

What is claimed is:

1. A trowel for smoothing mortar coated on the interior wall of a pipe, said trowel comprising an elastic member substantially spherical in shape for receiving pressurized air and inflating to a diameter less than the interior diameter of said pipe, and blade means having one end connected to and extending from said elastic member, and the other end of said blade means defining an outer circular surface substantially corresponding to the coated interior diameter of said pipe for engaging and smoothing said mortar.

2. The trowel of claim 1 wherein said blade means comprises a plurality of blade segments, each extending for an angular distance less than said interior diameter.

3. The trowel of claim 2 further comprising means connecting said blade segments together to permit relative radial movement between said segments.

4. The trowel of claim 3 wherein the end portions of said blade segments overlap and wherein said connecting means comprises a nut-bolt assembly having a spring extending between said nut and a corresponding overlapped blade segment.

5. The trowel of claim 4 wherein there are four segments, each extending for slightly more than 90°.

6. The trowel of claim 1, further comprising means for dragging said trowel through said pipe, and a disc connected to said means for dragging said trowel and secured to said elastic member.

7. The trowel of claim 6 in which said disc is formed with a concave interior configuration to conform to exterior shape of said elastic member.

8. The trowel of claim 7 in which flexible means are provided for connecting said one end of said blade means to said elastic member.

9. The trowel of claim 8 in which said flexible means comprises a cuff member, one end of which is secured to said elastic member and the other end of which is connected to said blade means.

10. The trowel of claim 9 in which said cuff member is formed with four openings at ninety degree intervals, and further comprising nut and bolt assemblies mounted in said four openings, said blades means being formed with through holes for receiving said nut and bolt assemblies.

* * * * *